US005287139A

United States Patent [19]

Inoue

[11] Patent Number: 5,287,139

[45] Date of Patent: Feb. 15, 1994

[54] DRIVE MECHANISM

[75] Inventor: Yuji Inoue, Kanagawa, Japan

[73] Assignee: Fuji Photo Film Co., Ltd., Kanagawa, Japan

[21] Appl. No.: 779,315

[22] Filed: Oct. 18, 1991

[30] Foreign Application Priority Data

Oct. 19, 1990 [JP] Japan ..... 2-282295

[51] Int. Cl.[5] ..... G03D 3/08

[52] U.S. Cl. ..... 354/320

[58] Field of Search ..... 354/297, 299, 319-321, 354/323, 324, 339

[56] References Cited

U.S. PATENT DOCUMENTS 4,045,809 8/1977 Landers ..... 354/322

FOREIGN PATENT DOCUMENTS 59-28901 7/1984 Japan .

*Primary Examiner*—D. Rutledge

*Attorney, Agent, or Firm*—Sughrue, Mion, Zinn, Macpeak & Seas

[57] ABSTRACT

A drive mechanism for conveying a photosensitive material in a processing tank filled with processing solution such as a developer, wherein a driving force from a driving source disposed outside the processing tank is transmitted to conveyor rollers located inside the processing tank through a pair of magnetic members. One of the magnetic members is located inside the processing tank and the other is located outside the processing tank so that the magnetic members face each other with the wall surface of the processing tank between them. Accordingly, the outside magnetic member is rotated by the driving force from the driving source. The rotation is transmitted to the inside magnetic member by means of a magnetic force, which rotates the conveyor rollers. The driving force is transmitted without a driving shaft or the like through the wall of the processing tank. Further, the processing tank can be made sufficiently airtight, thereby reducing degradation of the processing solution by oxidation.

21 Claims, 5 Drawing Sheets

DRIVE MECHANISM

BACKGROUND OF THE INVENTION

1. Field of the Invention

The present invention relates to a drive mechanism suitable for conveying photosensitive material within a processing apparatus.

2. BACKGROUND INFORMATION

A processing apparatus, e.g. an automatic developing apparatus where an article to be processed is conveyed in processing tanks containing processing solution therein, is provided with a developing tank, a fixing tank and a washing tank which are box-shaped. A developing rack is placed in the developing tank. A fixing rack and a washing rack are similarly placed in the fixing tank and washing tank respectively. The developing rack, the fixing rack and the washing rack are each provided with an appropriate number of conveyor rollers, guides and the like.

The photosensitive material to be developed by such an automatic developing apparatus, is inserted through an insertion opening and conveyed for processing by conveyor rollers, guides and the like to the developing rack, the fixing rack, the washing rack, etc. for processing. After being washed by water in the washing tank, the photosensitive material is removed through an outlet after being dried in a drying section.

Conventionally, a motor has been employed as a driving source in this type of automatic developing apparatus. The driving force from the motor is transmitted to the conveyor rollers of each processing rack through a transmission shaft positioned adjacent to the vicinity of the upper portion of the processing rack. In other words, the transmission shaft is provided with a worm gear corresponding to each processing rack and the worm gear meshes a main gear placed on one side plate of each processing rack. Further, a driven shaft for supporting the main gear at its axis, crosses above the top of each tank so that the driving force can be transmitted, in turn, to a driven gear placed on the other side plate of each processing rack causing a plurality of conveyor rollers which convey the photosensitive material to rotate. In case such a drive mechanism comprising transmission shaft of the driving force, a driven shaft, a driven gear and the like is used, the drive mechanism is located above the upper portion of each tank so that the upper portion thereof is not completely enclosed, resulting in the disadvantage that air enters from the outside of tanks. Consequently, particularly in case of a developing tank, there has been the problem that oxidation of the developer is accelerated, since the developer accommodated in the developing tank reacts continuously with oxygen in the air.

SUMMARY OF THE INVENTION

In view of the afore-mentioned fact, it is an object of the present invention to provide a drive mechanism which is capable of keeping air flow above the upper portion of the processing tank to a minimum, and further preventing oxidation of a processing solution in the processing tank from degrading.

According to the present invention, a driving force is transmitted from outside to inside through a pair of magnetic members which are separated by the wall of a processing tank located therebetween. Therefore, the pair of magnetic members positioned inside and outside of the wall of the processing tank faces each other and a magnetic field of the outside magnetic member interacts with the inside magnetic member so that the rotating force supplied to the outside magnetic member is transmitted to the inside magnetic member. Since there is no need to provide a drive shaft that penetrates the wall, the number and the size of opening formed above the processing tank may be reduced to a minimum, and air flow coming into the processing tank may be reduced. Thus, the oxidation of processing solution can be prevented from degrading.

DESCRIPTION OF THE PREFERRED EMBODIMENT

Figure 2:
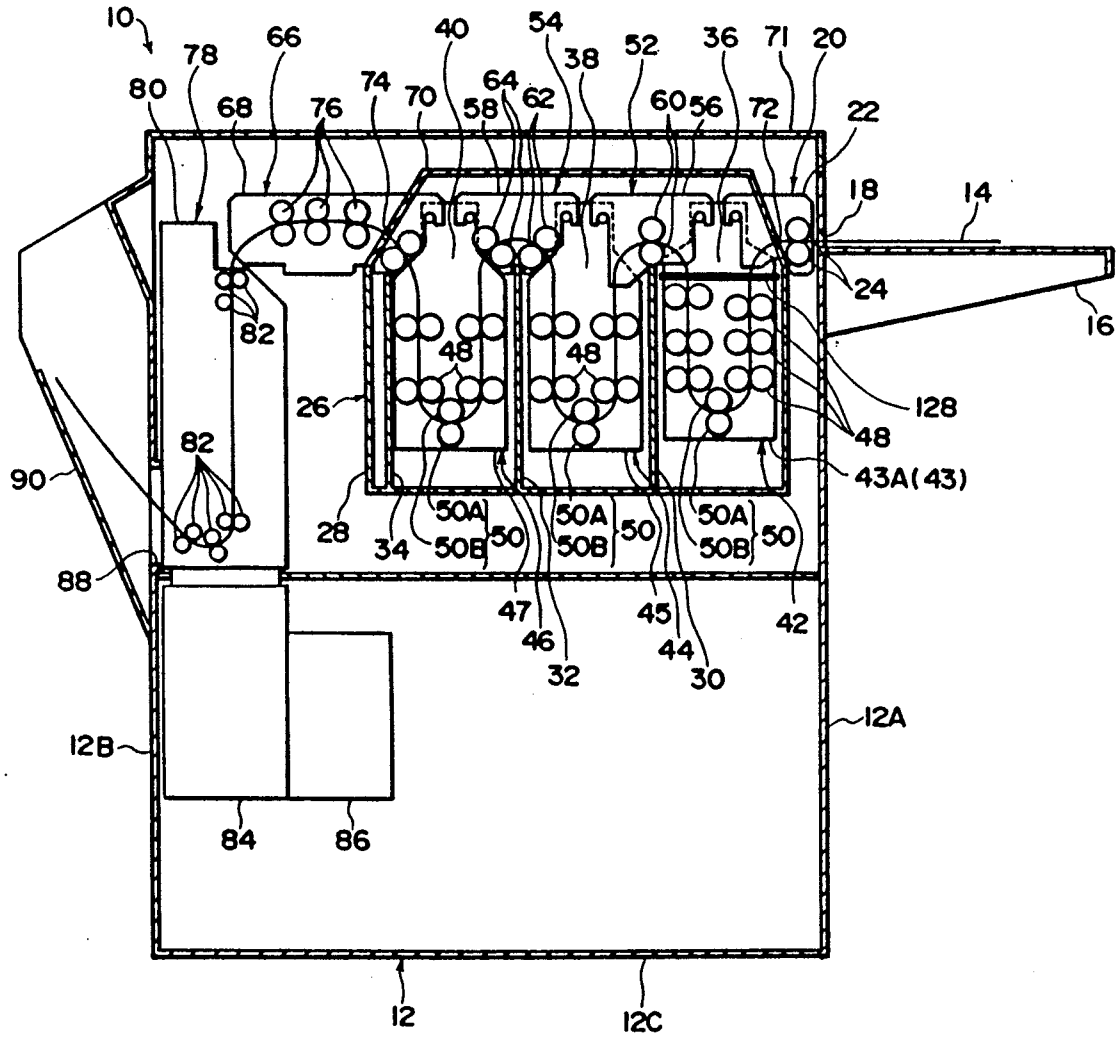
FIG. 2 is a schematic sectional view of the automatic processing apparatus shown in FIG. 1.

FIG. 2 shows a preferred embodiment of an automatic developing apparatus 10. First, an overall construction of the automatic processing apparatus 10 will be explained.

The automatic processing apparatus 10 is provided with a casing 12 in a substantially rectangular parallelepiped shape. When a main power switch (not shown) provided on the casing 12 is turned on, the automatic processing apparatus 10 is actuated. The casing 12 is provided with a guide plate 16 for placing a photosensitive material 14 at one side wall 12A (right-hand side wall in FIG. 2). The side wall 12A of casing 12 is also provided with an insertion opening 18 in the neighborhood of the guide plate 16 for inserting the photosensitive material 14. A developing inlet rack 20 is located further inside the insertion opening 18. A pair of rollers 24 are axially supported to a pair of side plates 22 of a developing inlet rack 20.

The photosensitive material 14 is conveyed by the pair of rollers 24 and guided into a processing section 26 located within the automatic processing apparatus 10.

The processing section 26 is provided with a box-shaped processing tank 28 and a cover 70 fitted to the upper end thereof for covering the top of the processing tank 28. The cover 70 is convexed in the vertical direction of the automatic processing apparatus 10 and substantially inverted dish shaped. The cover 70 is also provided with an inlet slit 72 at the slanted portion of the cover 70 near the insertion opening 18 for passing the photosensitive material 14 therethrough. Similarly, an outlet slit 74 is formed at the other slanted portion of the cover 70 near the outlet 88.

The processing tank 28 is divided into three separate tanks by three partition walls 30, 32, 34 so as to be horizontally disposed side by side. These three tanks are referred to as a developing tank 36, a fixing tank 38 and a washing tank 40 with the developing tank 36 being the nearest to and the washing tank 40 farthest from the insertion opening 18. A developer 41 (see FIG. 4) is accommodated in the developing tank 36. Also a fixing solution is accommodated in the fixing tank 38 while a washing water is in the washing tank 40. A developing rack 42 is inserted and immersed into the developer 41 in the developing tank 36. Similarly, a fixing rack 44 is inserted and immersed in the fixing solution in the fixing tank 38. A washing rack 46 is inserted and immersed in the washing water in the washing tank 40.

The developing rack 42 is provided with a side plate pair 43 consisting of substantially rectangular shaped side plates 43A and 43B of which the upper portions protrude upwards. Only one side plate 43A is shown in FIG. 2. A plurality of roller pairs 48 is axially supported by the side plate pair 43 along a conveying path of photosensitive material 14, i.e. a U-shaped path which descends and then reverses to ascend within the developing rack 42 so as to ensure a predetermined time for developing the photosensitive material 14. In addition, a conveyor roller pair 50 consisting of a driving roller 50A and a driven roller 50B, is located at a position where the photosensitive material 14 is reversed within the developing rack 42. A rotation axis 102 (see FIG. 1) of the driving roller 50A is provided to fix a main gear (not shown) at one end of the side plate 43A at the opposite side in FIG. 2. The main gear also engages a sub gear (not shown) which also engages rotation axis gears (not shown) of a plurality of roller pairs 48, on a rotation axis of the driven roller 50B. This causes the driving roller 50A and the driven roller 50B to rotate opposite each other at identical rotating speeds and further causes the interacting pair of rollers 48 to rotate opposite each other at identical rotating speeds. In the same manner as mentioned above, a fixing rack 44 and a washing rack 46 are each provided with side plate pairs 45 and 47 respectively, by which a plurality of roller pairs 48 and conveyor roller pairs 50 are axially supported, respectively.

Directly above the partition walls 30, 32, crossover racks 52, 54 are disposed over the partition walls 30, 32, respectively. Each crossover rack 52, 54 has respective side plate pairs 56, 58, by which the axes of roller pairs 60, 62 and 64 are supported. Therefore, the photosensitive material 14 is conveyed from the developing tank 36 into the fixing tank 38 by means of the crossover rack 52 adjacent to the developing inlet rack 20. In addition, the material 14 is conveyed from the fixing tank 38 into a washing tank 40 by means of the crossover rack 54 on the side of the outlet 88 (described hereinafter).

Above the washing rack 46, a squeeze rack 66 is located adjacent to a crossover rack 54 on the outlet 88 side. Side plate pair 68 of squeeze rack 66 is provided with a plurality of squeeze rollers 76, for squeezing off excess water adhering to the photosensitive material 14 after being washed.

A drying rack 78 is located below the squeeze rack 66 and comprises a side plate pair 80, in which a plurality of roller pairs 82 are provided for conveying photosensitive material 14 downward as shown in FIG. 2. Also below the drying rack 78, a heater housing 84 containing a heater (not shown) and a fan housing 86 containing a fan (not shown) are located. The heater housing 84, fan housing 86, and drying rack 78 form a drying portion which dries the photosensitive material 14 conveyed from the washing tank 40.

The lower part of drying rack 78 is in communication with an outlet 88 formed in a side wall 12B of a casing 12. The photosensitive material 14 after being dried at the drying rack 78, is turned up at the lower part of the drying rack 78, and moved through the outlet 88 so as to be carried onto a tray 90.

Figure 1:
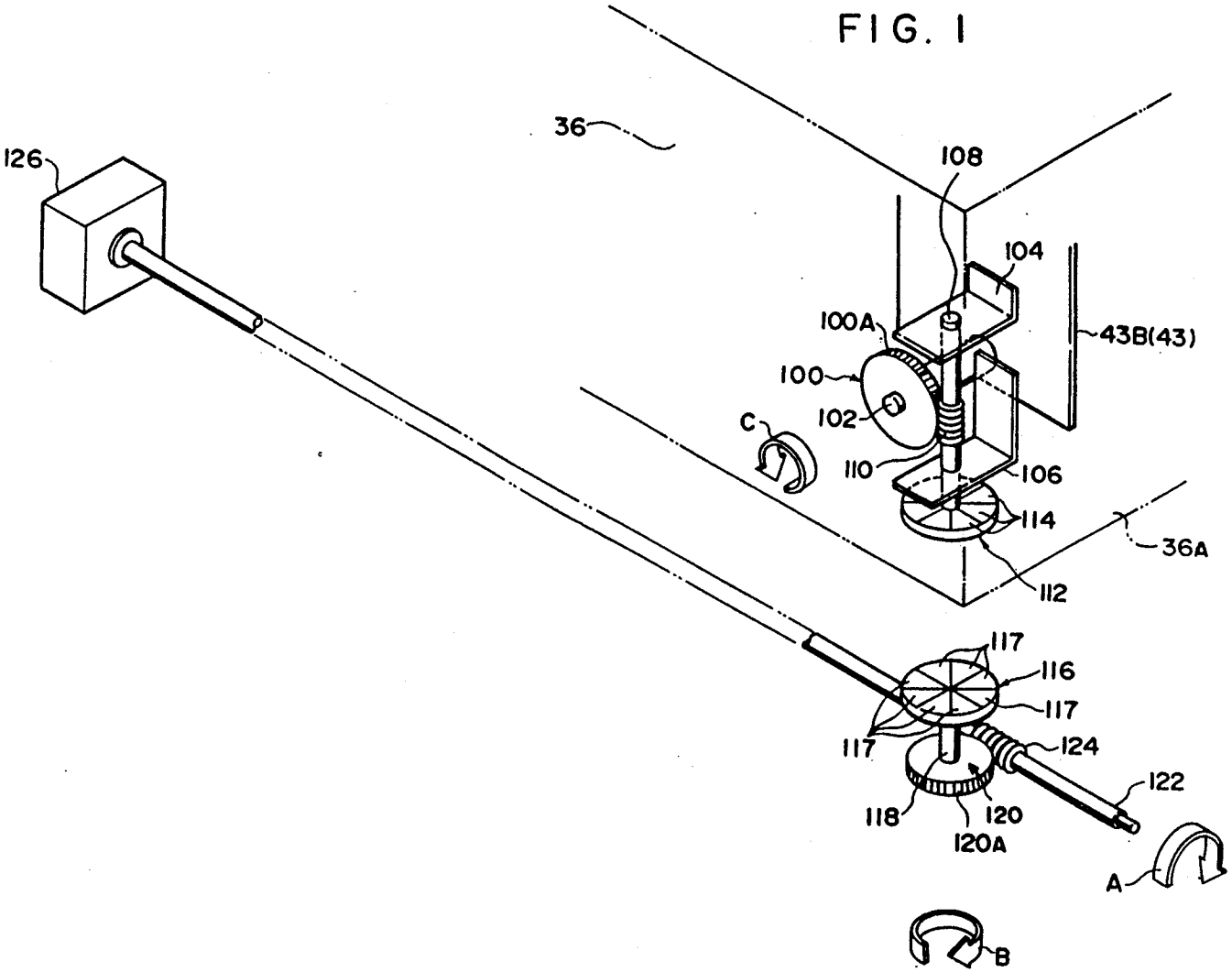
FIG. 1 is a perspective view of a drive mechanism of an automatic processing apparatus according to an embodiment of the present invention.
Figure 3:
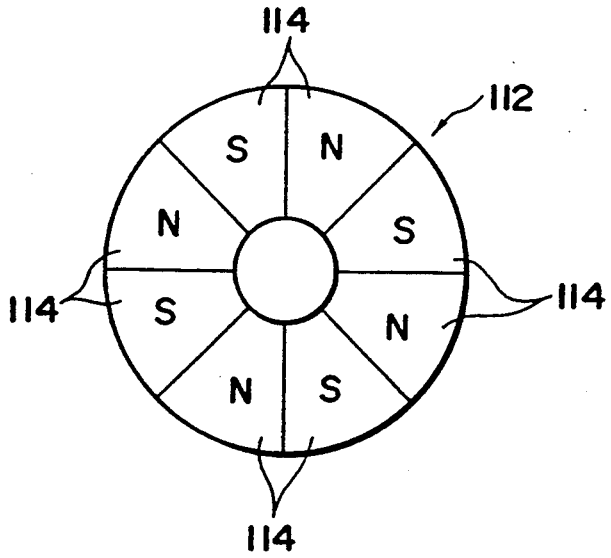
FIG. 3 is a plan view of a first disc magnet shown in FIG. 1.
Figure 4:
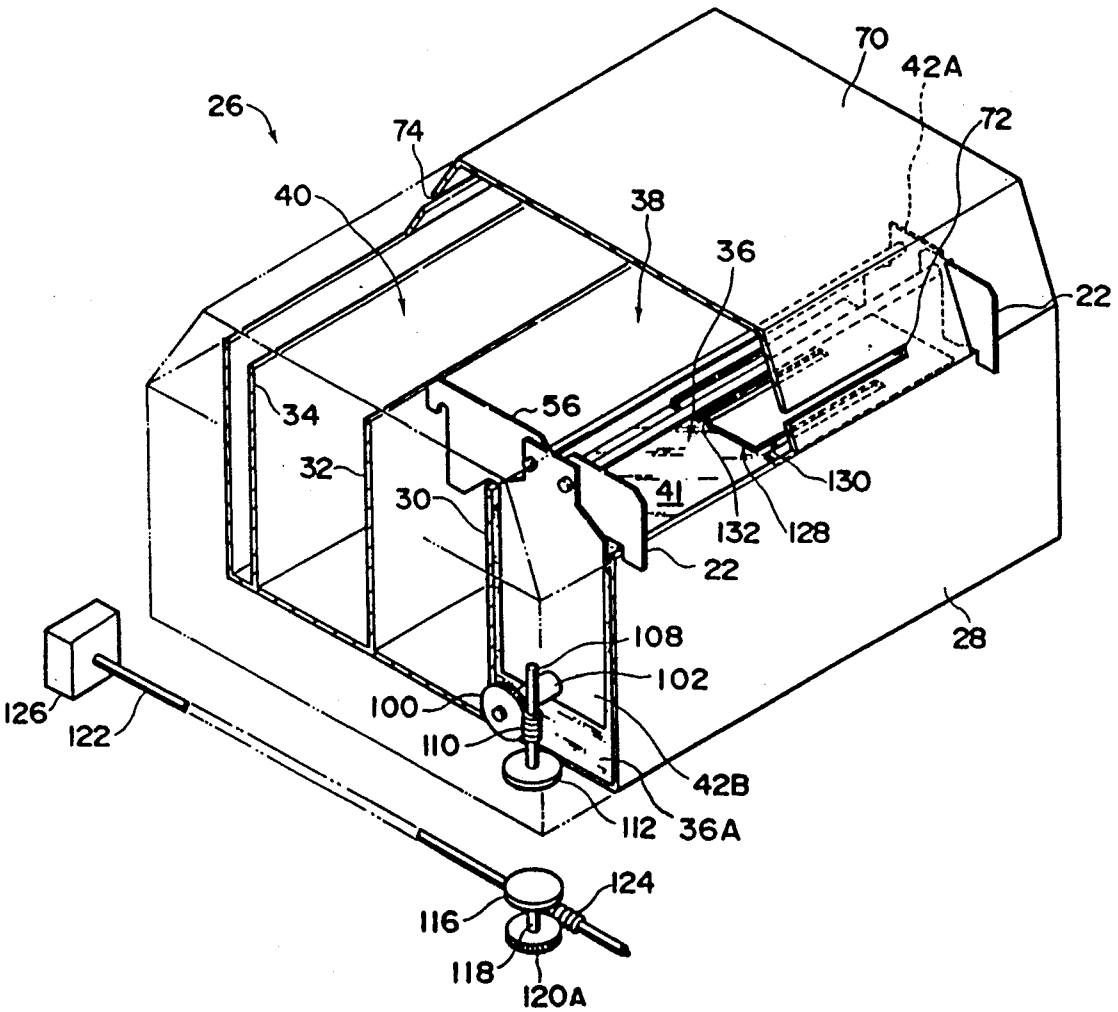
FIG. 4 is a perspective view of a floating lid of the developing tank and the cover of the processing tank shown in FIG. 2.

Referring now to FIGS. 1, 3 and 4, a drive mechanism of the above-mentioned automatic processing apparatus 10 will be explained in detail, particularly with reference to developing tank 36.

As shown in FIGS. 1 and 4, a worm wheel 100 is placed outside another side plate 43B positioned at the side opposite to the side plate 43A (see FIG. 2) of a developing rack 42. The worm wheel 100 is supported coaxially to a rotation axis 102 of a driving roller 50A. A pair of brackets 104 and 106 (not shown in FIG. 4) are located apart from the worm wheel 100 at both sides of the radial direction of worm wheel 100 (in the vertical direction of the developing tank 36). Each one side L-shaped bracket 104, 106 is fixedly secured to the side plate 43 of the developing rack 42, respectively. The pair of brackets 104, 106 are penetrated by a shaft 108 positioned along the tangent line of worm wheel 100. The middle section in the axial direction of the shaft 108 is integrally constructed with a worm gear 110, which is engaged with gear teeth 100A of worm wheel 100. Consequently, the rotation of the shaft 108 causes the worm wheel 100 to rotate via the worm gear 110.

A first disc magnet 112 is fixedly secured coaxially to the shaft 108 at the through end of bracket 106 which is fixed to the lower part of side plate 43 of developing rack 42. As shown in FIG. 3, the first disc magnet 112 comprises eight permanent magnet sectors 114. These permanent magnets 114 are each arranged so as to be opposite in pole to their respective adjacent magnets 114. Further, the magnets are arranged to be round in plan view. The first disc magnet 112 is also disposed to be, to some extent, from the bottom wall 36A (see FIG. 1) made of non-magnetic material.

A second disc magnet 116 is positioned opposite to the first disc magnet 112, these magnets being separated by the bottom wall 36A of developing tank 36. The second disc magnet 116 is constructed with eight permanent magnet sectors 117 and are disposed in the same manner as the first disc magnet 112. The second disc magnet 116 is also spaced from the bottom wall 36A of the developing tank 36 by a predetermined distance. Each permanent magnet 114, 117 of the first and the second disc magnets 112, 116 have opposing poles to their respective adjacent magnets and these facing each other so that the first disc magnet 112 and the second disc magnet 116 strongly attract each other.

The second disc magnet 116 is fixedly secured to one end of a shaft 118 disposed orthogonally at the axial center of the magnet 116. A worm wheel 120 is mounted to the other end of the shaft 118. This enables the second disc magnet 116 and the worm wheel 120 to rotate integrally with each other. The gear teeth 120A of the worm wheel 120 further engage a worm gear 124 integrally formed at one part of a driving shaft 122 positioned along the tangent line of worm wheel 120. One axial end of the driving shaft 122 is coupled to a motor 126. During operation of an automatic processing apparatus 10, the motor 126 has a torque of about 0.07 [kgf-m]. The torque obtained when the first disc magnet 112 and the second disc magnet 116 are rotated by means of a driving force of the motor 126, is equal to that of the rotation of a driving shaft by a motor of a conventional automatic processing apparatus without using the driving mechanism of the present embodiment at electric power of approximately 0.01 [kw/h].

Although the above explanation has been made in conjunction with the developing tank 36, worm gears 124 of the driving shaft 122 are also provided at the fixing tank 38 and at the washing tank 40, respectively. The fixing tank 38 and the washing tank 40 are provided with worm wheel 120, second disc magnet 116, first disc magnet 114, worm gear 110 and worm wheel 100 in the same manner as in the developing tank 36 as shown in FIG. 1 (in FIGS. 1 and 4 these elements of the fixing tank 38 and the washing tank 40 are omitted).

Further, as shown in FIG. 4, a rectangular flat plate floating lid 128 is placed on a surface of a developer 41 accommodated in the developing tank 36 (it should be noted that the lid 128 is shown in FIG. 4, as being cut at a middle section in its longitudinal direction). The floating lid 128 has an inlet slit 130 and an exit slit 132 at positions (see FIG. 4) corresponding to the conveyor path of the photosensitive material 14.

The operation of the present invention will be explained hereinafter.

When the main switch (not shown) of an automatic processing apparatus 10 is turned on, a motor 126 rotates a driving shaft 122 in the direction of arrow A shown in FIG. 1. As a result, a worm gear 124 rotates in the same direction so as to rotate a worm wheel 120 and a second disc magnet 116 in the direction of arrow B in FIG. 1. Accordingly, a first disc magnet 112 and the second disc magnet 116 are attracted by each other and the first disc magnet 112 rotates as the second disc magnet 116 rotates. A worm gear 110 then rotates in the same direction so as to rotate a worm wheel 100 in the direction of arrow C shown in FIG. 1.

The rotation of the worm wheel 100 causes a driving roller 50A (see FIG. 2) to rotate and then a driven roller 50B to rotate. The rotating force of the driven roller 50B is transmitted to a plurality of roller pairs 48 through a gear (not shown). A developing rack 42 is thus capable of conveying photosensitive material 14.

A fixing rack 44 and a washing rack 46 also convey the photosensitive material 14 by means of the transmission of a driving force. Further, the driving force is transmitted to a developing inlet rack 20, crossover racks 52, 54, a squeeze rack 66 and a drying rack 78.

In this state, the photosensitive material 14 is inserted through an insertion opening 18. The inserted photosensitive material 14 is held and conveyed by a pair of rollers 24 of the developing inlet rack 20, and conveyed into a developing tank 36 through an inlet slit 72 of a cover 70 and an inlet slit 130 of a floating lid 128. In the developing tank 36, the photosensitive material 14 is then developed while being conveyed along a U-shaped path by a plurality of roller pairs 48 and conveyor roller pairs 50 of the developing rack 42. The developed photosensitive material 14 is turned downward and conveyed by a roller pair 60 of a crossover rack 52 after being passed through an exit slit 132 of a floating lid 128. Thereafter, the material 14 is fixed in a fixing tank 38 and further washed in a washing tank 40 after it is conveyed and turned downward by roller pairs 62, 64 of a crossover rack 54. After the photosensitive material 14 passes an outlet slit 74 of a cover 70, excess water thereof is then squeezed off by means of a plurality of squeeze rollers 76 of a squeeze rack 66. Thereafter, the photosensitive material 14 is conveyed by a plurality of roller pairs 82 of drying rack 78, and dried by air from a heater and a fan (not shown). After the above process is completed, the photosensitive material 14 is removed through an outlet 88 and stacked on a tray 90.

As described above, in this embodiment of the present invention, the first disc magnet 112 and the second disc magnet 116 are positioned apart from the bottom surface of the developing tank 36 and face each other. A driving force of the motor 126 is transmitted by means of the attractive force of these disc magnets 112 and 116. This results in elimination of a driving mechanism above the processing tank 28 and, thereafter, the upper part of the processing tank 28 can be sealed. The conveyor roller pair 50 disposed at the lower part of the developing tank 36 can also be used for the transmission of the driving force.

As a result, the air flow within the processing tank 28 can be minimized by covering the processing tank 28 with cover 70 having the inlet slit 72 and the outlet slit 74. The floating lid 128 having the inlet slit 130 and the outlet slit 132 only, is placed on the surface of the developer 41 in the developing tank 36 so as to be in contact with the developer 41, and the developer 41 is in contact with the resident air via the inlet slit 130 and the outlet slit 132. Therefore, the degradation by oxidation of the developer 41 can be kept to a minimum. Additionally, since a cover 71 is placed at the upper part of the casing 12 to minimize air flow between the vicinity of the above portion of the processing tank 28 and the outside of the automatic processing apparatus 10, degradation by the oxidation of the developer 41 can be minimized. As the photosensitive material 14 can be developed by such developer 41, the photosensitive material 14 can be processed in a stable condition without employing a replenishing unit to compensate the degradation by the oxidation of the developer 41. Thus, a reduction of running cost can be achieved when employing the automatic processing apparatus 10 according to the present invention.

And yet, above the processing tank 28, both the cover 70 and the floating lid 128 may be used, or either one of them may be used.

According to this embodiment of the present invention, a first disc magnet 112, a shaft 108 and a pair of brackets 104, 106 are mounted to a side plate 43 of a developing rack 42, and a worm wheel 100 and a rotational axis 102 are attached to the developing rack 42 in a preceding assembling process. Therefore, the developing rack 42 can be simply inserted into a developing tank 36, and a simplified assembling process can be achieved.

Figure 5:
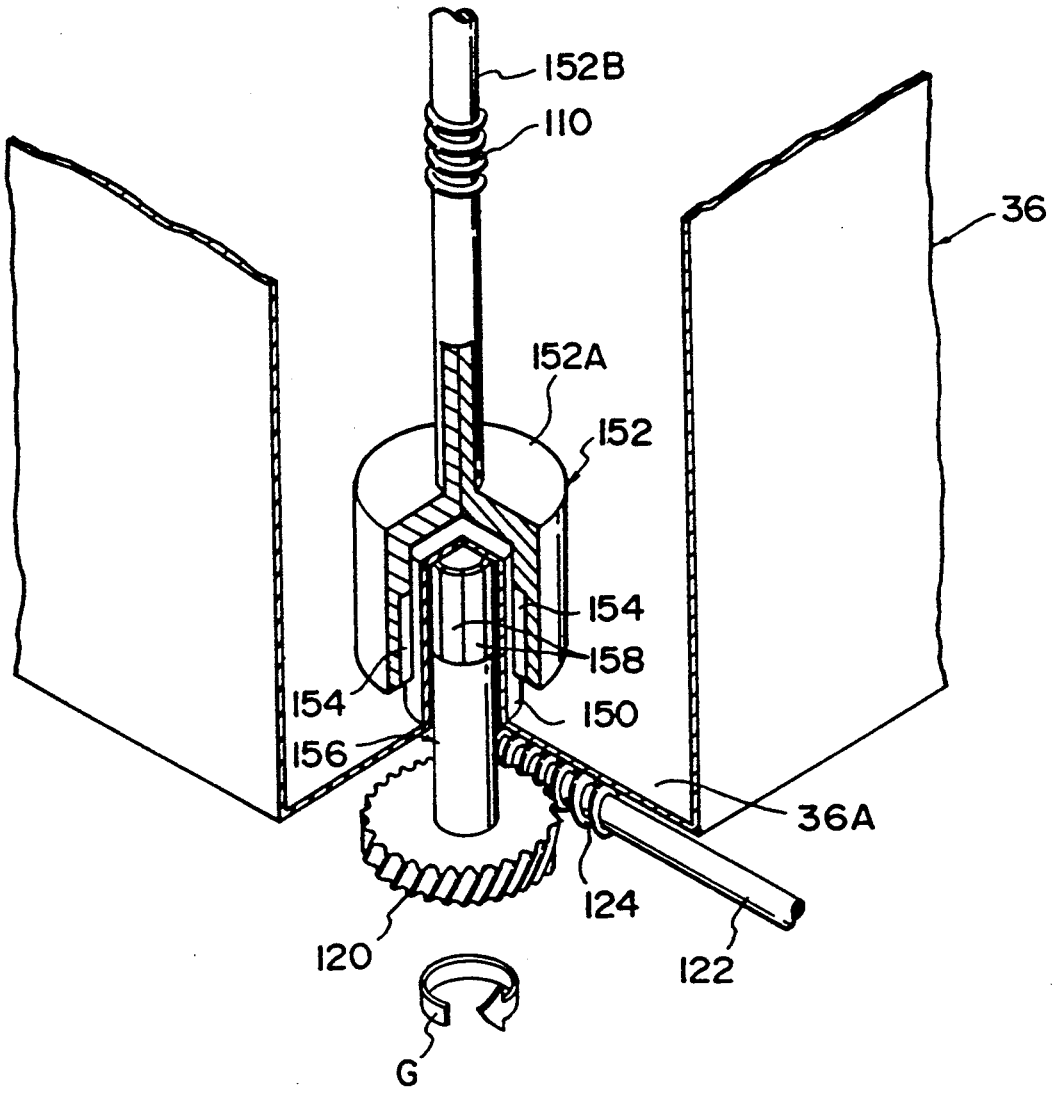
FIG. 5 is an enlarged perspective view of a main part showing a modified form of a first disc magnet and a second disc magnet shown in FIG. 1.

Also, in the present embodiment, while a first disc magnet 112 and a second disc magnet 116 are constructed so as to opposingly face each other, these magnets being separated by the bottom wall of the developing tank 36, another construction of a second embodiment as shown in FIG. 5 may be applied without being limited to the above embodiment.

In this second embodiment of the present invention, a bottom wall of a developing tank 36 has an intruding portion 150 which intrudes toward the opening of the developing tank 36. The intruding portion 150 is cylindrical in shape with a closed end in the direction of the opening of the developing tank 36. A cup-shaped magnet 152 is freely fitted outside the intruding portion 150. The magnet 152 has a larger diameter than the intruding portion 150, and a cup-shaped body 152A and a shaft 152B extended from an axial shaft of the body 152A toward the opening of the developing tank 36.

Both axial ends of the shaft 152B are supported by a pair of brackets 104, 106 (see FIG. 1) in the same manner as in the embodiment as described hereinbefore.

Also a worm gear 110 is integrally formed in the middle part axially of the shaft 152B and is engaged with a worm wheel 100 (see FIG. 1). These pair of brackets 104, 106 and the worm wheel 100 are not shown in FIG. 5.

A plurality of permanent magnets 154 are arranged in an inner perimeter of the body 152A of cup-shaped magnet 152 so that these magnets have poles opposite to their respective adjacent magnets. Each permanent magnet 154 is shaped in a sector in the longitudinally perpendicular section.

Inside the intruding portion 150, a cylindrical magnet 156 is disposed apart from the intruding portion 150 so that a plurality of permanent magnets 158 are arranged and the poles of the magnets 158 are opposite to the poles of magnets adjacent thereto around one axial end (e.g. the end portion at the side of cup-shaped magnet 152). Each permanent magnet 158 is shaped in a sector in the longitudinally perpendicular section, similar to the above permanent magnets 154. Also each permanent magnet 154 of cup-shaped magnet 152 and each permanent magnet 158 of cylindrical magnet 156, have poles opposite to the poles of the facing magnets, causing them to attract each other.

Worm wheel 120 shown in FIG. 1 is fixed coaxially with the cylindrical magnet 156 at the other end in the axial direction. The worm wheel 120 is coupled to motor 126 through worm 124 and driving shaft 122.

According to the second embodiment of the present invention as described above, a driving force from a motor 126 is transmitted to a worm wheel 120 through a worm gear 124 to rotate the worm wheel 120 in the direction of arrow G as shown in FIG. 5. This permits the rotation of a cylindrical magnet 158 together with the worm wheel 120. Then a cup-shaped magnet 152 attracts the cylindrical magnet 158 and rotates in the direction of the arrow G as shown in FIG. 5. The rotating force of the cup-shaped magnet 152 is transmitted to a worm wheel 100 through a worm gear 110. thereby rotating the worm wheel 100. Consequently, the driving force of motor 126 is securely transmitted to a conveyor roller pair 50 disposed in the lower part of a developing tank 36 without need of a construction such that a bottom wall of the developing tank 36 is penetrated. In the same manner as in the first embodiment, the embodiment described herein enables the degradation of oxidation of a developer 41 to be kept to a minimum.

Also in the above-mentioned embodiments the first disc magnet 112, second disc magnet 116, cup-shaped magnet 152 and cylindrical magnet 156 each comprise permanent magnets 114, 117, 154 and 158 respectively. Electromagnets may be used instead of permanent magnets. Any other construction where magnetized magnets are respectively arranged inside and outside the wall of processing tank so as to face each other and driving force of a motor can be transmitted by means of magnetic power, can be applied. This also can be applied to the modified example hereinbefore described.

Further, although the first disc magnet 112 and second disc magnet 116 of the first embodiment each have eight permanent magnet sectors 114, 117 respectively, the number of magnet sectors 114, 117 is not limited to eight, but any even number of sectors can be used.

Although a photosensitive material 14 has been employed as an article to be conveyed in the embodiment described hereinbefore, any other article which can be processed and conveyed in a processing tank filled with a processing solution, can be applied.

While, as shown in each embodiment hereinbefore described, the present invention has been shown and suited to a processing apparatus for conveying an article to be processed in a processing tank filled with a processing solution, it is also suited for any apparatus wherein an article is conveyed within a housing, in which processing solution is not accommodated therein, such as a drying apparatus for drying the article while being conveyed in a drying section, and not being limited to the above-described embodiments.

What is claimed is:

1. A drive mechanism for conveying an article within a housing, comprising:

a conveying means for conveying said article located inside said housing;

a first magnetic member, facing an inner surface of said housing, and located at one end of said conveying means;

a second magnetic member, facing said first magnetic member, located outside said housing, and transmitting a rotating force to said first magnetic member by means of a magnetic force; and a driving source provided outside said housing, which supplies a rotating force to said second magnetic member for conveying said article in the housing by transmitting a rotating force to said conveying means via said first and second magnetic members, wherein the rotating force of the second magnetic member is transmitted to the first magnetic member without direct contact between said first and second magnetic members separated by one of the walls of said housing.

2. A drive mechanism according to claim 1, wherein said first magnetic member and said second magnetic member are both flat plates and arranged coaxially so that the opposing surfaces of these magnetic members are parallel to each other.

3. A drive mechanism according to claim 2, wherein both parallel surfaces of said first and second magnetic members are parallel to the wall of said housing being disposed between said first and second magnetic members.

4. A drive mechanism according to claim 1, wherein one of said first and second magnetic members is cup-shaped defining an opening while the other is an axial member fitted into said opening.

5. A drive mechanism according to claim 4, wherein the inner periphery of said cup-shaped magnetic member facing said axial member and the outer periphery of said axial member generate magnetic force.

6. A drive mechanism according to claim 5, wherein a part of a wall of said housing is bent so as to be cup-shaped and is disposed between said cup-shaped magnetic member and said axial member.

7. A drive mechanism according to claim 1, wherein said magnetic members each comprise a magnetic generator comprising a combination of a plurality of magnets, wherein said magnets each have a pole opposite to their respective adjacent magnets.

8. A drive mechanism according to claim 1, wherein said housing is provided with a cover so as to close the housing and block fluid flow-through between the inside and the outside of said housing.

9. A drive mechanism for conveying a photosensitive material in a processing tank filled with a processing solution such as a developer, comprising:

a conveying means disposed in said processing tank for conveying said photosensitive material in said processing tank;

an inside magnetic member coupled to a rotating shaft of said conveying means and disposed adjacent to an inner surface of said processing tank;

an outside magnetic member disposed outside said processing tank, adjacent to the outer surface of said processing tank, and forming a magnetic field including said inside magnetic member; and a driving source for rotating said outside magnetic member to rotate the inside magnetic member by said magnetic field and to convey said photosensitive material into a processing solution by means of said conveying means.

10. A drive mechanism according to claim 9, wherein both said inside magnetic member and said outside magnetic member are disc-shaped and coaxially arranged so that a surface of each magnetic member faces that of the other magnetic member.

11. A drive mechanism according to claim 10, wherein said surfaces facing each other run parallel with a wall surface of the processing tank.

12. A drive mechanism according to claim 10, wherein both said surfaces of said magnetic members are provided with a plurality of magnets around axial shafts respectively, wherein the pole of each magnet is opposite to that of the magnet adjacent thereto.

13. A drive mechanism according to claim 10, wherein said inside magnetic member is coaxially coupled to the rotational shaft of said conveying means and wherein said outside magnetic member is coaxially coupled to the rotational shaft of said driving source.

14. A drive mechanism according to claim 9, wherein said inside magnetic member and said outside magnetic member are coaxially arranged with each other, one being arranged in the periphery of the other.

15. A drive mechanism according to claim 14, wherein said outside magnetic member has a cylindrical shape.

16. A drive mechanism according to claim 15, wherein an inner perimeter of one of said magnetic members and an outer perimeter of the other magnetic member are each provided with magnets so that a magnetic field is formed by the magnets.

17. A drive mechanism according to claim 14, wherein a wall surface of the processing tank disposed between said magnetic members has a cylindrical shape.

18. A drive mechanism according to claim 17, wherein said inside magnetic member is coaxially coupled to the rotational shaft of said conveying means and wherein said outside magnetic member is coaxially coupled to the rotational shaft of said driving source.

19. A drive mechanism according to claim 9, wherein said processing tank is provided with a cover for covering its upper opening, so that the communication between the processing tank and the outside of the tank is limited to the entrance for the photosensitive material.

20. A drive mechanism for conveying a photosensitive material during processing in a processing tank filled with processing solution such as a developer, comprising:

a conveying means disposed in said processing tank, comprising at least a plurality of roller pairs for conveying said photosensitive material during processing said photosensitive material in the processing solution while said photosensitive material is held by said rollers;

a disc-shaped inside magnetic member, coaxially coupled to a rotational shaft of said conveying means and disposed adjacent an inner surface of said processing tank;

a disc-shaped outside magnetic member, disposed outside said processing tank and adjacent an outer surface of said processing tank, and arranged coaxially with said inside magnetic member; and a driving source coaxially coupled to said outside magnetic member to rotate said outside magnetic member so as to rotate the inside magnetic member by a magnetic field formed between a pair of said magnetic members, and for conveying said photosensitive material in the processing solution by means of said conveying means.

21. A drive mechanism for conveying a photosensitive material during processing the photosensitive material in a processing tank filled with a processing solution such as a developer, comprising:

a conveying means disposed in said processing tank, comprising at least a plurality of roller pairs for conveying said photosensitive material during processing said photosensitive material in the processing solution while said photosensitive material is held by said rollers;

an inside magnetic member coupled coaxially to a rotational shaft of said conveying means and disposed adjacent an inner surface of said processing tank;

an outside magnetic member disposed outside said processing tank and adjacent an outer surface of said processing tank so as to be coaxial with said inside magnetic member, wherein one of said magnetic members is cylindrically shaped and is arranged at the outer periphery of the other and a magnet is placed at the inner periphery of the one magnetic member and a magnet is placed at the outer periphery of the other magnetic member so that the magnets face each other; and a driving source coaxially coupled to said outside magnetic member to rotate the outside magnetic member for rotating the inside magnetic member by a magnetic field formed betweeen a pair of said magnetic members, and for conveying said photosensitive means.

* * * * *